United States Patent [19]

Williams

[11] Patent Number: 4,599,954

[45] Date of Patent: Jul. 15, 1986

[54] SEWAGE SLUDGE DISPOSAL PROCESS AND APPARATUS THEREFOR

[75] Inventor: Robert M. Williams, Ladue, Mo.

[73] Assignee: Williams Patent Crusher and Pulverizer Company, St. Louis, Mo.

[21] Appl. No.: 705,308

[22] Filed: Feb. 22, 1985

[51] Int. Cl.[4] ..... F23G 7/04

[52] U.S. Cl. ..... 110/346; 110/232; 110/238; 110/347

[58] Field of Search ..... 110/238, 346, 220, 232, 110/347

[56] References Cited

U.S. PATENT DOCUMENTS

| | | | |
|---|---|---|---|
| 2,032,402 | 3/1936 | Colby et al. | 110/220 |
| 2,066,418 | 1/1937 | O'Mara | 110/220 |
| 2,148,447 | 2/1939 | Dundas et al. | 110/220 X |
| 2,148,981 | 2/1939 | Dundas et al. | 110/222 |
| 3,109,392 | 11/1963 | Riepl et al. | 110/222 |
| 3,357,375 | 12/1967 | Brophy | 110/238 |
| 4,213,407 | 7/1980 | Headley | 110/238 X |
| 4,245,570 | 1/1981 | Williams | 110/238 |

*Primary Examiner*—Edward G. Favors

*Attorney, Agent, or Firm*—Gravely, Lieder & Woodruff

[57] ABSTRACT

A process for disposal of wet sewage sludge by introducing a particulate material having BTU values, feeding the mixture to a grinding or milling apparatus in which the particulate material acts to prevent the sewage sludge caking in the apparatus during the reduction in the grinding or milling thereof, supplying hot gaseous medium to dry the mixture, with a portion of the hot mixture being recirculated to assist in the drying of the mixture as it is fed into the grinding or milling apparatus, and disposing of the resulting ground or milled mixture by burning with the aid of the BTU content of the particulate material.

5 Claims, 2 Drawing Figures

SEWAGE SLUDGE DISPOSAL PROCESS AND APPARATUS THEREFOR

BACKGROUND OF THE INVENTION

1. Field of the Invention

This invention relates to a process for disposing of sewage sludge with the aid of material having a BTU energy input.

2. Description of the Prior Art

The prior art which best illustrates the disposal of sewage sludge is found in Colby et al U.S. Pat. No. 2,032,402 of Mar. 3, 1936 which provisionally may introduce pulverized coal to facilitate burning of the sludge. O'Mara U.S. Pat. No. 2,066,418 of Jan. 5, 1937 disposed of sludge directly in a furnace after mixing the wet sludge with dried sludge. There are two Dundas et al U.S. Pat. No. 2,148,447 of Feb. 28, 1939 and U.S. Pat. No. 2,148,981 of Feb. 28, 1939 which disclose elaborate apparatus for sewage waste disposal using coal to assist in the combustion of the waste, where the coal is prepulverized or powdered in advance of being introduced into the system.

Additional prior art is represented by Riepl et al U.S. Pat. No. 3,109,392 of Nov. 5, 1963 which introduces an outside fuel after the waste refuse has been comminuted; and Williams U.S. Pat. No. 4,245,570 of Jan. 20, 1981 which collects dried sludge and burns it with the aid of outside fuel for effecting the drying of the incoming sludge as it is being ground.

It has not been recognized by the workers in this art of disposing of sewage sludge that as the water is evaporated or removed from the initial raw sewage sludge, by whatever method, the thickening of the sludge results in a very sticky mass which easily plugs the apparatus to the extent that the disposal is retarded with excessive down time of the apparatus. Experience has shown that the sludge in losing water forms a coating on the surfaces of conduits and within the processing mills which reduces the efficiency of the apparatus. These unwelcome characteristics are not overcome by the practices taught by the known prior art as the outside fuel is not introduced until late in the operating cycle of the apparatus, and as a result the foregoing problems and other related or secondary problems which have accrued have not been successfully overcome.

BRIEF DESCRIPTION OF THE INVENTION

The sewage sludge disposal process of this invention has overcome the problems not addressed by the prior art by relying on the introduction of a material possessing a BTU value, such as coal, to perform the function of inhibiting the formation of troublesome coating of the sludge through using the coal to bombard the sludge and break it up to the extent that it mixes in the fluid bed and has little opportunity to form into a coating or cause plugging.

The principal objects of the invention are to avoid and overcome the problems encountered by prior art apparatus and practices, to provide a simplified process for disposing of sewage sludge, to introudce an outside fuel at an early stage in the process where it can perform the unique function of bombarding and breaking up sludge so it is prevented from coating and plugging, and to better apply the use of coal in sewage sludge disposal so use of the more costly fuels, such as oil or gas, is avoided.

A preferred process for disposal of sewage sludge comprises the steps of initially introducing raw coal and sewage sludge in a common mix, subjecting the mix of coal and sewage to a milling reduction such that the coal functions during the reduction to bombard and break up the sludge, introducing a hot gaseous medium to the milling of the sludge and coal to reduce the moisture, and burning the milled sludge and coal as a fuel to produce hot gaseous medium, a portion of which is used for drying the sludge during the milling step.

The process may also include the step of recirculating a portion of the mix of the insufficiently milled coal and sludge back to the initial introduction of coal and sewage sludge to advance the drying of the moisture while further milling the recirculated coal.

The invention also comprises the arrangement of apparatus for practicing the process hereinafter described, with reference to the drawings.

BRIEF DESCRIPTION OF THE DRAWINGS

The process of the present invention is practiced by apparatus of the character illustrated in the accompanying drawings, wherein.

DETAILED DESCRIPTION OF THE EMBODIMENT

Figure 1:
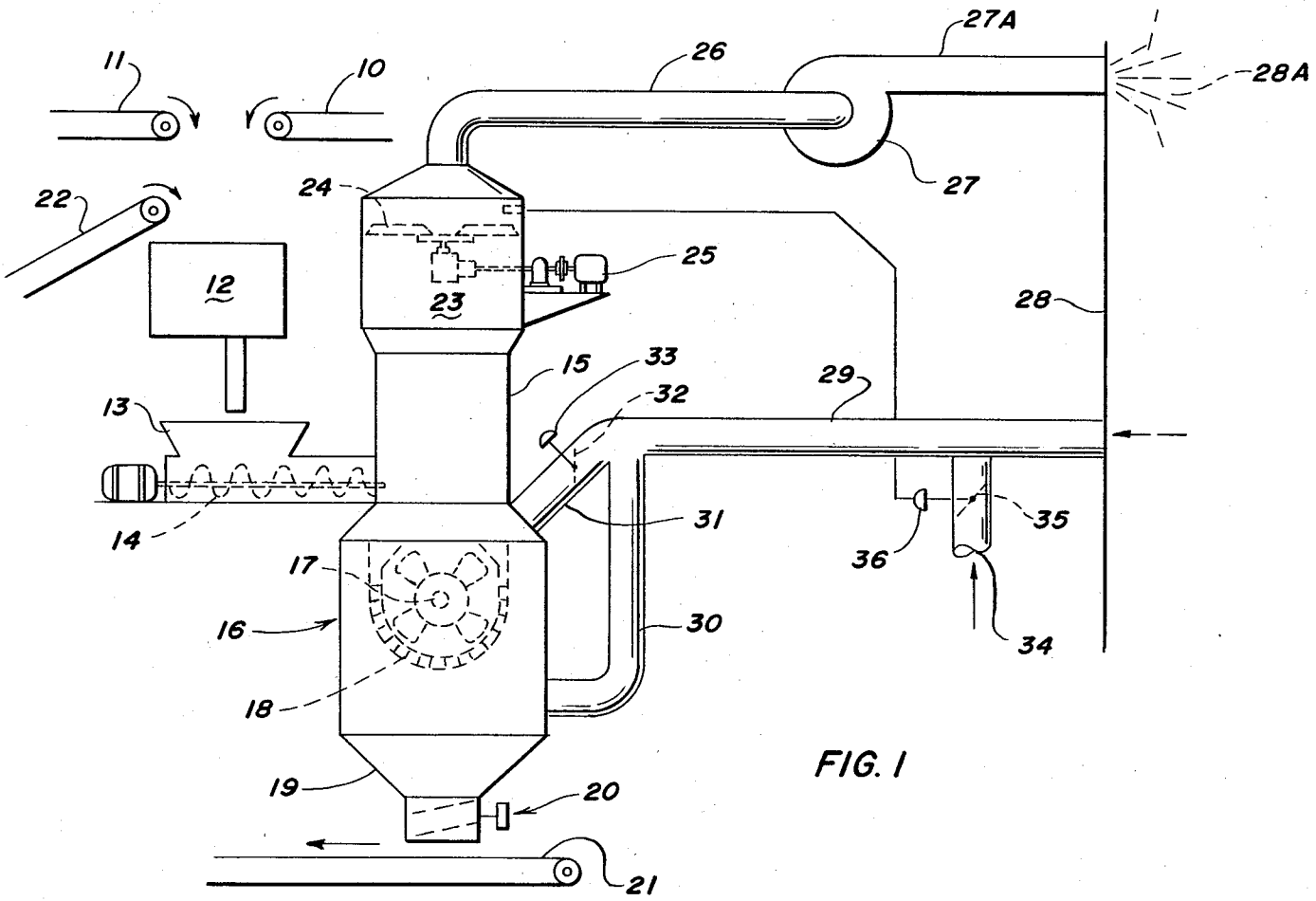
FIG. 1 is a schematic arrangement of the several components which cooperate in the disposal of sewage sludge.

An apparatus arrangement for practicing the method of the present invention is illustrated in FIG. 1 and is seen to include a conveyor 10 for delivering sewage sludge, which may be a composition of approximately 20% solids and 80% water, together with a conveyor 11 which introduces raw coal into the sewage sludge, so that the two types of material are delivered to a mixer 12 of a suitable type. After the sludge and coal are mixed, it is delivered to hopper 13 where it is transported by a feed screw 14 into the head stack 15 of a mill for grinding and reducing the combination sludge and coal. The latter apparatus comprises a mill 16 which may have a material grinder 17 of an impact type in which the material is ground and reduced in size. The mill 16 is formed with a grate 18 for the purpose of allowing the coal and sometimes hard to grind material to fall through into a bottom collector 19 where it is eventually discharged through a double flop gate 20 and collected on a recirculating conveyor 21 which delivers the discharge material into a recirculating conveyor 22 which delivers the material to the mixer 12 so that it can be added to the newly arriving materials through the above described system and reach the mill for further grinding. The conveyor 21 is connected to the conveyor 22 by a suitable conveying apparatus which is not shown but which is well known in the art.

The ground material is caused to pass upwardly from the mill 16 through the head stack 15 and into a classifier 23 which houses a separator rotor 24 driven through suitable shafting and gears by motor 25. The rotary separator functions to centrifically separate the large size material which will fall down along the walls of the classifier 23 and the head stack 15 for reintroduction into the mill 16. The finer material passes through the classifier 23 and into a discharge conduit 26 through the suction of a primary fan 27 which delivers the ground material through its outlet **27*a* to boiler 28 at a boiler burner 28***a*, which is only schematically indicated. The boiler generates hot gas which is collected in a heat exchanger where the heated gaseous medium may be delivered through conduit 29 and into a principal flow conduit 30 which opens into the mill 16 below the grate 18. The hot gas in introduced at this place in the mill so that it exerts a maximum drying effect on the material being reduced in the grinder 17. The hot gas medium raises the temperature of the material discharged through the double flop gate 20. Thus, the hot recirculating material moved by conveyor 21 to conveyor 22 is reintroduced at the mixer 12 to add its drying effect at that point in the system.

It is shown in FIG. 1 that the hot gas from the boiler heat exchanger may be partially diverted from the principal flow conduit 30 into a branch 31 under the control of a damper 32 operated by motor means 33. In addition, control over the temperature of the hot gas reaching the mill 16 may be modulated by introduction of ambient air through an inlet 34 controlled by a damper 35 under the operation of motor means 36, thereby allowing cool or ambient air to enter conduit 29. The modifying effect on the hot gas is to allow control over the drying process in the mill 16 as the temperature of the gas from the boiler heat exchanger may be in the order of 1000°-1200° F.

The introduction of raw coal into the system of the apparatus of FIG. 1 is unique in that it adds to the total volume of material being processed a component possessing sufficient BTU values to facilitate the burning of the sewage sludge in the boiler 28. The raw coal also has the unique effect of forming an abrasive texture to the sewage sludge to break up the tendency of the sludge during the drying process to cake and adhere to the surface in the mill 16 and associated conduits, the drying stack 15 and the classifier 23. The anti-caking reaction is produced because of the abrasive texture of the coal which produces a scrubbing action inside the apparatus so as to break up and inhibit caking of the sludge.

Figure 2:
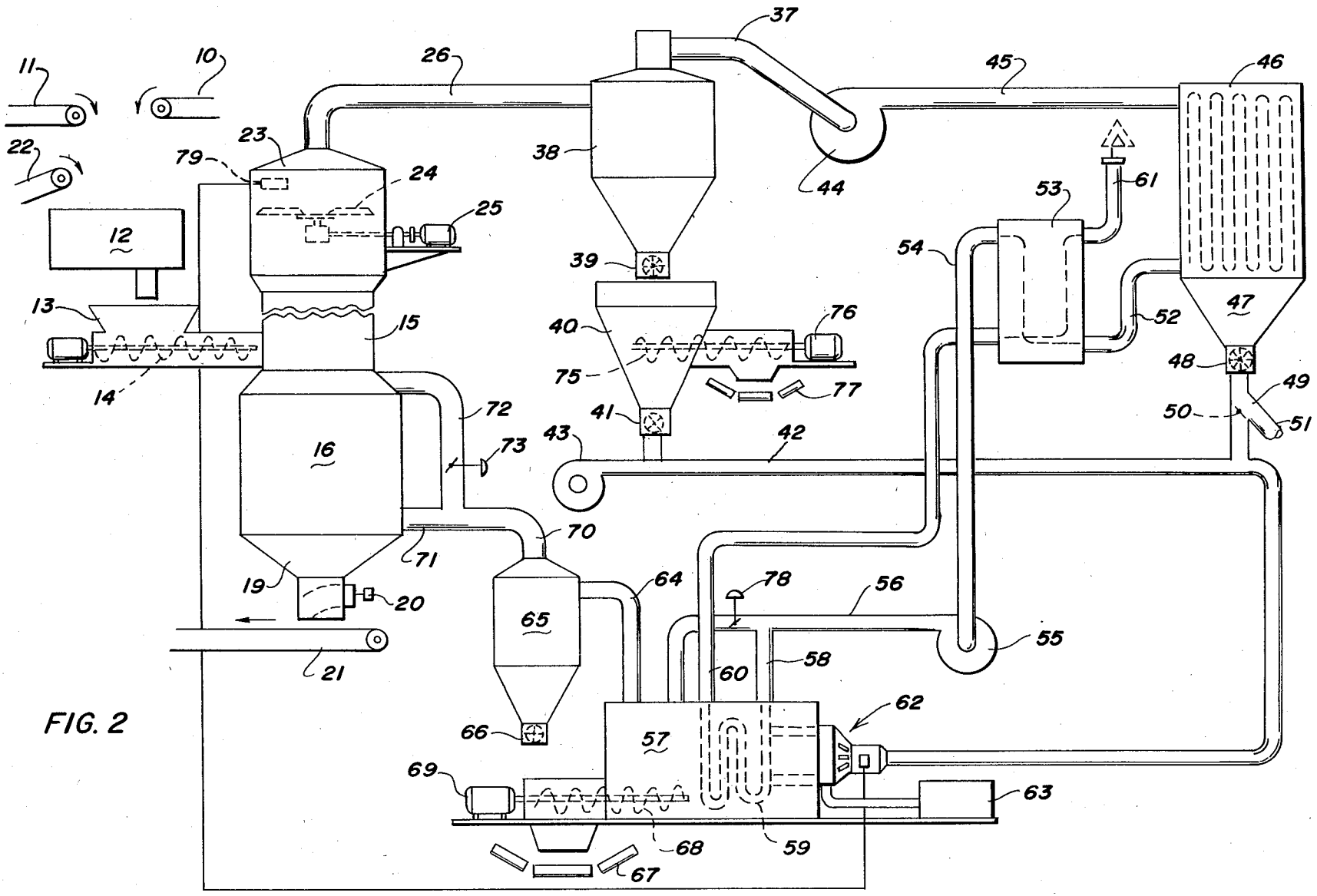
FIG. 2 is another schematic arrangement of apparatus in a modified organization of components.

Turning now to FIG. 2, a modified arrangement of apparatus is associated with components of the apparatus previously described in FIG. 1. Where the components of apparatus previously described have been identified by reference characters, the same characters will be applied to the same parts in FIG. 2. The modification comprises the provision of a cyclone separator 38 receiving the ground sewage sludge and coal from the outlet conduit 26 of the classifier 23. The cyclone 38 is provided with a rotary outlet valve 39 which allows the separated material from the gas to fall into a bin 40, and the bin is provided with a similar rotary outlet 41 for delivering the contents into a transport conduit 42 associated with a blower 43. Also the cyclone 38 is provided with an outlet 37 leading to the inlet of a primary fan 44 which has its outlet conduit 45 connected into a bag house 46 where the remaining fines can be extracted and collected in the bottom 47 of the bag house where it can eventually be exhausted through a rotary valve 48. The thus collected fines can be either discharged through the Y connection 49 where the valve element 50 in the Y connection can direct the fines either into the transport conduit 42 or direct the fines out of the system at the outlet 51.

However, the principal outlet from bag house 46 is provided by a conduit 52 which is connected into a heat exchanger 53 where the outlet 54 associated with the conduit 52 is connected into the suction side of a secondary fan 55. The fan outlet conduit 56 is connected into a furnace 57. The conduit 56 is provided with a branch conduit 58 for directing the cleaned gaseous medium into a furnace heat exchanger coil 59. The coil outlet is at conduit 60 which leads back to the exchanger 53 and then to the exhaust 61. The furnace 57 is provided with a burner 62 having its own fan for combustion air. On start-up the burner is supplied with a suitable fuel from a source 63 and after the system has reached an equilibrium performance level the source 63 may be cut back as the dried material conveyed in transport conduit 42 can augment the fuel. The hot gases from the furnace 57 pass out through the stack 64 and into a cyclone 65 where any fines remaining are separated and discharged from the hot gas system through a rotary valve 66 for deposit on a conveyor 67. The ash residue in the furnace 57 may be extracted through the operation of a screw device 68 driven by motor 69 for dumping the ash residue onto the conveyor 67. The substantially clean hot gas leaves the cyclone 65 by a conduit 70 and is conducted into the mill 16 through a conduit 71 leading into the bottom area of the mill 16 so as to produce a drying effect on the material being reduced as well as on the coarse material dropping through the mill grate for eventual discharge from the mill through the double flop gate 20 where it is collected on a conveyor 21 and eventually recirculated by conveyor 22 to the mixer 12. A portion of the hot gas from conduit 70 may be introduced by a branch conduit 72 for delivering the hot gas to the inlet side of the mill 16 under the control of a damper operated by motor means 73.

It is observed in FIG. 1 that the heat for drying the material during reduction in the mill is obtained from a heat exchanger in the boiler 28. In FIG. 2, the heat is generated in the furnace 57 by directing the dried ground and reduced material into the transport conduit 42 which leads to the burner 62 to enable substantial reduction in outside fuel from source 63. In collecting the output of dried material from the bin 40, there is a screw skimmer 75 operated by motor 76 to extract excess material and dump it onto conveyor 77 which conducts it to a suitable collecting station for subsequent sale or the land fill. The ash collected at conveyor 67 is similarly treated for sale or for land fill.

The heat exchange coil 59 in furnace 57 enables the gaseous medium from the bag house to be heated to a temperature high enough to destroy any objectionable odor before it is released to the outside. Recovery of some of the odor destroying heat takes place at the heat exchanger 53. A balance in the heat at the exchanger 53 and in the furnace stack 64 may be obtained by a motor operated damper 78 in conduit 56, and the operation of the burner 62 is controlled by a temperature control 79 in the head of the classifier 23.

It should now be apparent that the process of the present invention involves the disposal of sewage sludge and any objectionable odor in connection therewith in which the sewage sludge is mixed with coal or a suitable material adding sufficient BTU heat values, such as bark, wood and the like, the mixture is then ground in a suitable mill and subjected to a hot gaseous medium for drying the moisture so that the ground and dried, or sufficiently dried mill ouput, can be blown into a boiler for direct firing or consumed in a furnace as indicated above. The process also involves collecting insufficiently ground material in the mill and recirculating it back to the inlet side of the mill for addition to the incoming supply of material. The apparatus for practicing the process is arranged to direct the primary hot gaseous medium into the mill so it passes through the material in the mill for maximum drying effect.

An important feature of the process is the introduction of material, whether it is coal or bark or some equivalent material having BTU values, along with the sewage sludge for the express function of employing that added material to bombard the sewage sludge and prevent it from becoming a sticky mass capable of coating, caking and plugging the apparatus. The added material performs the function of scrubbing the interior to prevent the sewage sludge becoming difficult to process and improving its ability to be disposed of by burning.

What is claimed is:

1. A process for inhibiting the formation of surface coating of sewage sludge in apparatus for disposing of wet sewage sludge which comprises the steps of:
   (a) bringing wet sewage sludge and a solid grindable particulate material together to form a mixture;
   (b) feeding the thus formed mixture into grinding apparatus and relying on the particulate material to inhibit the sewage sludge forming a coating in the grinding apparatus;
   (c) supplying a hot gaseous medium to the mixture of the sewage sludge and particulate material during the grinding thereof for drying the same; and
   (d) reintroducing a portion of the ground mixture of sewage sludge and particulate material to the grinding apparatus for imparting its drying heat to the feeding of the mixture.

2. A process for inhibiting the formation of surface coating of sewage sludge on apparatus for disposing of wet sewage sludge comprising the steps of:
   (a) initially mixing sewage sludge and a material having a sufficient BTU content to support eventual combustion of the sewage sludge and possessing an abrasive particulate characteristic;
   (b) subjecting the mixture of sewage sludge and the granular material to grinding to reduce the mixture to a substantially homogeneous particulate condition and for making use of the granular characteristic of the material to break up caking of the sewage sludge;
   (c) introducing a hot gaseous medium to the mixture during the initial grinding step to initiate drying of the mixture; and
   (d) reintroducing to the grinding step granular material insufficiently reduced initially by the grinding step for further reduction and for adding the retained heat to the drying step.

3. The process set forth in claim 2 wherein the introduction of the hot gaseous medium is directed upwardly through the mixture in the grinding step and the insufficiently ground particulate material moves counter to the direction of the hot gaseous medium reintroduction to the mixing step.

4. A process for inhibiting the formation of surface coating of sewage sludge on apparatus for disposing of wet sewage sludge comprising the steps of:
   (a) delivering wet sewage sludge and raw coal to a mixer for simultaneously distributing the coal throughout the wet sewage sludge:
   (b) subjecting the mixture of wet sewage sludge and coal to a grinding step in which the coal particles are caused to from an abrasive texture throughout the sewage sludge to inhibit caking of the wet sludge during grinding thereof;
   (c) delivering the ground sewage sludge and coal to a zone of combustion where the abrasive texture is applied to break up coating by the sludge and where the combustible value of the coal promotes disposal of the sewage sludge and results in hot gaseous medium production;
   (d) introducing at least a portion of the hot gaseous medium to the mixture during the grinding step for drying thereof; and
   (e) recirculating at least a portion of heated coarse ground coal and sewage sludge into the delivery of wet sewage sludge and coal for mixing into the wet sewage sludge and raw coal in the mixer to inhibit caking and promote the scrubbing action inside the apparatus and evaportion of the moisture in the sewage sludge.

5. Apparatus arranged for co-grinding sewage sludge and a particulate material having an abrasive nature as well as a fuel value for inhibiting the formation of a coating on the interior surfaces of the apparatus and promoting the disposal of the sewage sludge by burning, said apparatus arrangement being characterized by:
   (a) grinding mill for the co-grinding of sewage sludge and a particulate material to reduce the co-ground sludge and particulate to an abrasive condition throughout, said grinding mill having an outlet for the ground sewage and particulate material;
   (b) feeder means in position for receiving the abrasive mixture of the sewage sludge and particulate material;
   (c) fan means connected by its inlet with said grinding mill, and having an outlet for delivering the output of said grinding mill;
   (d) combustion means connected to said fan means outlet for burning the co-ground sewage sludge and granular material;
   (e) hot gas conducting means connecting said combustion means with said mill for supplying the hot gas to said grinding mill to dry the moisture content of the sewage sludge, said fan means moving the co-ground sludge and particulate abrasive material through said conducting means to inhibit the formation of a coating therein; and
   (f) temperature responsive means disposed at said grinding mill outlet for monitoring the heat input into said grinding mill.

* * * * *

UNITED STATES PATENT AND TRADEMARK OFFICE

CERTIFICATE OF CORRECTION

PATENT NO. : 4,599,954

DATED : July 15, 1986

INVENTOR(S) : Robert M. Williams

It is certified that error appears in the above-identified patent and that said Letters Patent is hereby corrected as shown below:

Column 6, line 9, "from" should be "form".

Column 6, line 34, the word "a" should be inserted before "grinding mill".

Signed and Sealed this

Seventh Day of October, 1986

[SEAL]

*Attest:*

DONALD J. QUIGG

*Attesting Officer*

*Commissioner of Patents and Trademarks*